US006067832A

United States Patent [19]

Brand et al.

[11] Patent Number: 6,067,832

[45] Date of Patent: May 30, 2000

[54] PROCESS FOR THE PRODUCTION OF AN EVAPORATOR TUBE

[75] Inventors: Karine Brand, Neu-Ulm; Andreas Beutler, Senden; Manfred Knab, Dornstadt; Gerhard Schuez, Voehringen; Andreas Schwitalla, Illerrieden, all of Germany

[73] Assignee: Wieland-Werke AG, Ulm, Germany

[21] Appl. No.: 09/212,525

[22] Filed: Dec. 16, 1998

[30] Foreign Application Priority Data

Dec. 23, 1997 [DE] Germany ..... 197 57 526

[51] Int. Cl.[7] ..... B21D 53/06

[52] U.S. Cl. ..... 72/98; 29/890.05

[58] Field of Search ..... 29/890.048, 890.05; 72/98

[56] References Cited

U.S. PATENT DOCUMENTS

| | | | |
|---|---|---|---|
| 1,865,575 | 7/1932 | Locke . | |
| 3,327,512 | 6/1967 | Novak et al. . | |
| 3,696,861 | 10/1972 | Webb | 165/133 |
| 4,216,826 | 8/1980 | Fujikake | 165/133 |
| 4,577,381 | 3/1986 | Sato et al. | 29/157.4 |
| 4,660,630 | 4/1987 | Cunningham et al. | 165/133 |
| 5,054,548 | 10/1991 | Zohler | 165/133 |
| 5,697,430 | 12/1997 | Thors et al. | 29/890.05 |

FOREIGN PATENT DOCUMENTS

| | | | |
|---|---|---|---|
| 0 713 072 | 5/1996 | European Pat. Off. . | |
| 28 08 080 | 8/1978 | Germany . | |
| 27 58 526 | 7/1979 | Germany . | |
| 2160450 | 12/1985 | United Kingdom | 29/890.05 |

*Primary Examiner*—Lowell A. Larson

*Attorney, Agent, or Firm*—Flynn, Thiel, Boutell & Tanis, P.C.

[57] ABSTRACT

A process for producing a heat exchanger tube (1) with a highly porous surface structure, in particular for evaporating liquids from pure substances or mixtures on the outside of the tube. The process starts from a rolling operation, by means of which helical fins (2) are produced on the outside of the tube, which fins, in turn, are deformed in a plurality of compression steps by means of gearwheel-like compression wheels (6, 7) in such a manner that the projections **(12*a*, 12*b*) formed in each case form a cover (3*a*) for the passages (3) which are situated between the fins (2). The high level of porosity is achieved as a result of the remaining pores (13) and/or slots (14)**.

12 Claims, 7 Drawing Sheets

PROCESS FOR THE PRODUCTION OF AN EVAPORATOR TUBE

FIELD OF THE INVENTION

The invention relates to a process for producing a heat exchanger tube, in particular for the evaporation of liquids from pure substances or mixtures on the outside of the tube and, more particularly, to a process for forming passage-like structures on the outside of tubes which have fins formed out of the tube wall on the outside. These structures are used to make the heat transfer more intensive when evaporating liquids from pure substances and mixtures on the outside of the tube.

BACKGROUND OF THE INVENTION

Evaporation takes place in numerous sectors of refrigeration and air-conditioning engineering as well as in process and power engineering. In the prior art, tubular heat exchangers are often used, in which liquids evaporate from pure substances or mixtures on the outside of the tube and, in the process, cool a medium which is flowing on the inside of the tube. Such appliances are known as flooded evaporators.

By making the heat transfer on the outside and inside of the tube more intensive, it is possible to reduce the size of the evaporators considerably. As a result, the production costs of such appliances fall. Moreover, the volume of refrigerant required is reduced, which is important in view of the fact that the chlorine-free safety refrigerants which are predominantly used nowadays may form a not insubstantial portion of the overall equipment costs. If toxic or combustible refrigerants are used, reducing the volume of these refrigerants allows the potential hazard to be lowered. The tubes with passage-like structures on the outside which are customarily used nowadays are more efficient by a factor of about three than smooth tubes of the same diameter.

Prior art:

The present invention relates to a process for producing tubes with a structured outer side, the structure serving to increase the outside surface area and the heat transfer coefficient for the evaporation of liquids on the outside of the tube. In order to increase the heat transfer coefficient during evaporation, the process of nucleate boiling is made more intensive. It is known that the formation of bubbles begins at nucleation sites. These nucleation sites are generally small gas or vapor inclusions at the surface. When the growing bubble has reached a certain size, it becomes detached from the surface. If, in the course of the bubble becoming detached, the nucleation site is flooded with liquid which is continuing to flow in, under certain circumstances the gas or vapor inclusion will be displaced by liquid. In this case, the nucleation site is inactivated. This can be avoided by suitably designing the nucleation site. To do this, it is necessary for the opening of the nucleation site to be smaller than the cavity lying below it, as for example in structures of re-entrant type.

It is known to produce such structures on the basis of integrally rolled finned tubes in which the fins have been formed out of the tube wall by rolling. Integrally rolled finned tubes are understood to mean finned tubes in which the fins have been formed out of the wall material of a smooth tube. For such finned tubes to be used in tubular heat exchangers, it is in many cases necessary for the external diameter of the tube in the finned region to be not greater than the external diameter of the unfinned end sections and skip sections of the tube.

Various processes are known with which the passages situated between adjacent fins are closed off in such a manner that connections between passages and environment remain in the form of pores or slots. Liquid and vapor can be conveyed through these pores or slots. In particular, such essentially closed passages are produced by bending over or flanging the fins (U.S. Pat. No. 3,696,861, U.S. Pat. No. 5,054,548), by splitting and compressing the fins (DE-C 2,758,526, U.S. Pat. No. 4,577,381), by notching and completely compressing the fins (U.S. Pat. No. 4,660,630, EP-B 0,713,072) or by notching and compression which is offset to one side of the fins (U.S. Pat. No. 4,216,826 and the parallel DE-28,08,080 A1).

To further increase the heat transfer capacity, it is necessary to increase the outer surface area of the tube and number of passages by increasing the number of fins per unit length of the tube. In order to combine a short distance between fins with a structure of high porosity (=relative volumetric capacity proportion of the passages), it is necessary to reduce the thickness of the fins. In so doing, the processes mentioned above come up against the limits of manufacturing stability:

As the distances between adjacent fins become smaller, the tools used for flanging or bending over the fin (U.S. Pat. No. 3,696,861, U.S. Pat. No. 5,054,548) have to be made in an increasingly filigree form. Owing to unavoidable fluctuations, which lie within engineering tolerance limits, in the dimensions of the smooth tube (e.g. in the wall thickness), changes in the forces which are active during the finning process occur along the tube, resulting, when the fin is formed asymmetrically (by being bent over or flanging), in undesirable irregularities in the slot width or in the pattern of pores. As the structure becomes finer, these irregularities become increasingly serious.

In the case of thin fins, central splitting of the fin, as proposed in DE-C 2,758,526 and U.S. Pat. No. 4,577,381, can no longer be economically realized under manufacturing conditions.

Experience has shown that thin fins become bent or collapse during the compression operation if the operation is carried out as described in U.S. Pat. No. 4,660,630 and EP-B 0,713,072. It is therefore impossible to produce a structure of high porosity.

In the case of offset compression in accordance with U.S. Pat. No. 4,216,826, thin fins have a tendency to buckle to one side. Consequently, this process can only be controlled with extreme difficulty in the case of thin fins and is therefore unsuitable for mass production.

As the outer structure becomes finer, i.e. the fins become thinner, the reduction in the stability of the fin increasingly becomes the major difficulty. If the entire upper region of the fin is simultaneously deformed under the compressive load imparted by the tool, the fin collapses instead of forming a cover above the passage. It is better to break the deformation down into partial steps. DE 28,08,080 A1 already refers to this fact. In the above-mentioned document, it is proposed that the entire fin should not be deformed in a single operation, but rather the tool used for the deformation is to be arranged in such a way that only one side of the fin is deformed in one operation (cf. FIG. 2 and 14 of DE 28,08,080 A1). However, in this process the fin is deformed in such a manner that, in the case of thick fins, the upper regions of the fin become thicker, as illustrated in FIG. 17 of DE 28,08,080 A1. The thickening of the upper fin regions is explicitly mentioned in patent claim 1 of the parallel U.S. Pat. No. 4,216,826. Therefore, thin covers are not formed above the passage and the desired high level of porosity cannot be realized. In the case of thin fins, these fins tend to buckle to one side in the event of axially single-sided compressive deformation of the fin tip. For this reason, this process can only be controlled with extreme difficulty in the case of thin fins and is therefore unsuitable for mass production.

Furthermore, it is proposed, in DE 28,08,080 A1 to deform the fins using a single, suitable tool in the fashion of a gearwheel, so that after further working steps grooves are formed in the axial direction of the tube. The material which is displaced in the gearwheel-like deformation lies below the outer surface of the tube and is therefore not used to form covers above the passages between the fins. Rather, it reduces the porosity and, furthermore, prevents liquid from being conveyed in the circumferential direction in the passages.

SUMMARY OF THE INVENTION

The invention is based on the object of essentially closing off the passages which are situated between adjacent fins of an integrally rolled fin tube using material from the upper region of the fins and of producing a structure of high porosity and uniformity on the outside of the tube, the intention being to close off the passages using as little material as possible.

The object is achieved according to the invention by means of a process which comprises the following steps:

a) helically running fins are formed on the outside of a smooth tube, the fin material being obtained by displacing material out of the tube wall by means of a rolling operation, and the finned tube which is formed is set in rotation by the rolling forces and/or is advanced in a manner which corresponds to the helical fins which are formed, the fins being formed out of the otherwise undeformed smooth tube with increasing height, b) in the region which is being deformed, the tube wall is supported by a roll mandrel which lies inside the tube, c) after they have been formed, the fins are subjected to a compression operation in order to form partially open passages between them, the fins being compressed by the radial compression depth X over their entire width in the axial direction, in a first compression step in sections in the circumferential direction, by means of a gearwheel-like compression wheel, so that fin material is displaced on both sides in the axial direction so as to form projections which form the first part of the passage cover, d) at least one further compression step with the radial compression depth Y is carried out over the entire width of the fins in the axial direction, by means of a gearwheel-like compression wheel, which radial compression depth Y is at least as great as the radial compression depth X in the first compression step, so that the passage cover is formed in a stepwise manner by joining together projections.

During the sectional compression, the material of the fin is displaced, on both sides in the axial direction, out of the upper region of the fin, within limited areas which are defined by the compression wheel. The displaced material forms projections above the passage which are used to form a cover. Following the first working step, the cover is formed only in the regions to the sides of the worked sections of the fin tip. In the following working steps, those sections of the fin tip which were not compressed in the first compression step are partially or completely compressed, so that the regions of the passage which are covered are widened. The thinner the covers of the passages, the lower the weight and therefore material costs of the tube become.

A high porosity results in a large specific contact surface between tube and surrounding medium and therefore increases the active heat transfer surface for the evaporation process. This increase in surface area contributes to increasing the effective heat transfer coefficient based on the enveloping surface.

Further advantageous variants of the process according to the invention occur when the outer surface of the tube is smoothed down by a smoothing wheel of constant diameter in order to ensure that the tube can be pushed into the tube sheet of a tubular heat exchanger without any problems.

If the tool is designed suitably, it is possible, in particular, for the projections produced in the first compression step to protrude as far as the center of the passage, so that projections of adjacent fins meet and, as it were, form a bridge above the passage. Owing to increasing compaction of the material, the projections which are formed in successive compression steps extend less far over the passage. In this way, it is possible to produce a surface structure in which the passages are in communication with the environment via pores. If the projections do not meet after the first working step, a surface structure with slot-like openings is formed in the following steps.

BRIEF DESCRIPTION OF THE DRAWINGS

The invention will be explained in more detail with reference to the following exemplary embodiments. In the figures.

DETAILED DESCRIPTION

An integrally rolled finned tube 1 with fins 2 which run helically around the outside of the tube, are spaced apart with the fin pitch t and are deformed so as to form passages 3 with passage cover 3*a* is produced by a rolling operation (cf. U.S. Pat. No. 1,865,575 and U.S. Pat. No. 3,327,512) by means of the device illustrated in FIG. 1.

Figure 1:
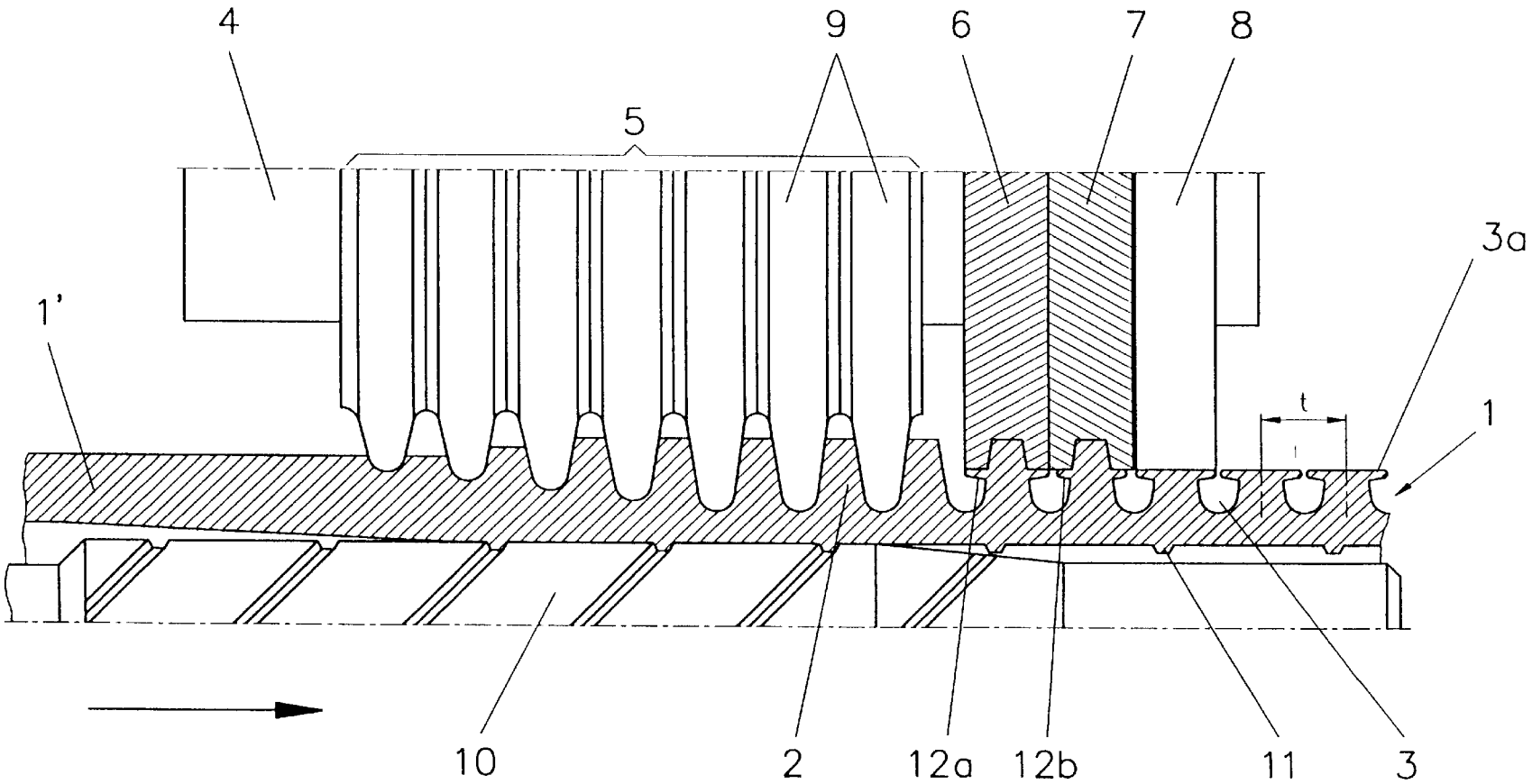
FIG. 1 shows a device for carrying out the process according to the invention, FIG. 2 diagrammatically shows two compression wheels with teeth which run at an angle to the axis of the wheels, FIGS. 3*a*–3*c* diagrammatically show the way in which the individual compression steps are carried out.

The device used comprises n=3 tool holders 4, in each of which a rolling tool 5 and two gearwheel-like compression wheels 6/7, as well as a smoothing wheel 8 of constant diameter, are incorporated (only one tool holder 4 is shown in FIG. 1. However, it is also possible, for example, to use 4 or more tool holders 4). The tool holders 4 are in each case arranged offset by $\alpha=360°/n$ over the circumference of the finned tube. The tool holders 4 are radially adjustable. For their part, they are arranged in a fixed rolling head, which is not shown (according to a different variant, the tube is advanced only in the axial direction, when the rolling head is rotating, by means of a separate device).

The smooth tube 1' which is fed into the device in the direction of the arrow is set in rotation by the driven rolling tools 5 which are arranged on the circumference, the axes of the rolling tools 5 running at an angle to the axis of the tube, so as to be able to produce helical fins 2. The rolling tools 5 comprise, in a manner known per se, a plurality of rolling wheels 9 which are arranged next to one another and the diameter of which increases in the direction of the arrow. The centrally arranged rolling tools 5 form the helically encircling fins 2 out of the wall of the smooth tube 1', the tube wall being supported, in the region undergoing deformation, below the rolling tools 5, in this case by means of a profiled roll mandrel 10. As a result, helically encircling fins 11 are simultaneously formed on the inside of the tube 1.

Figure 3A:
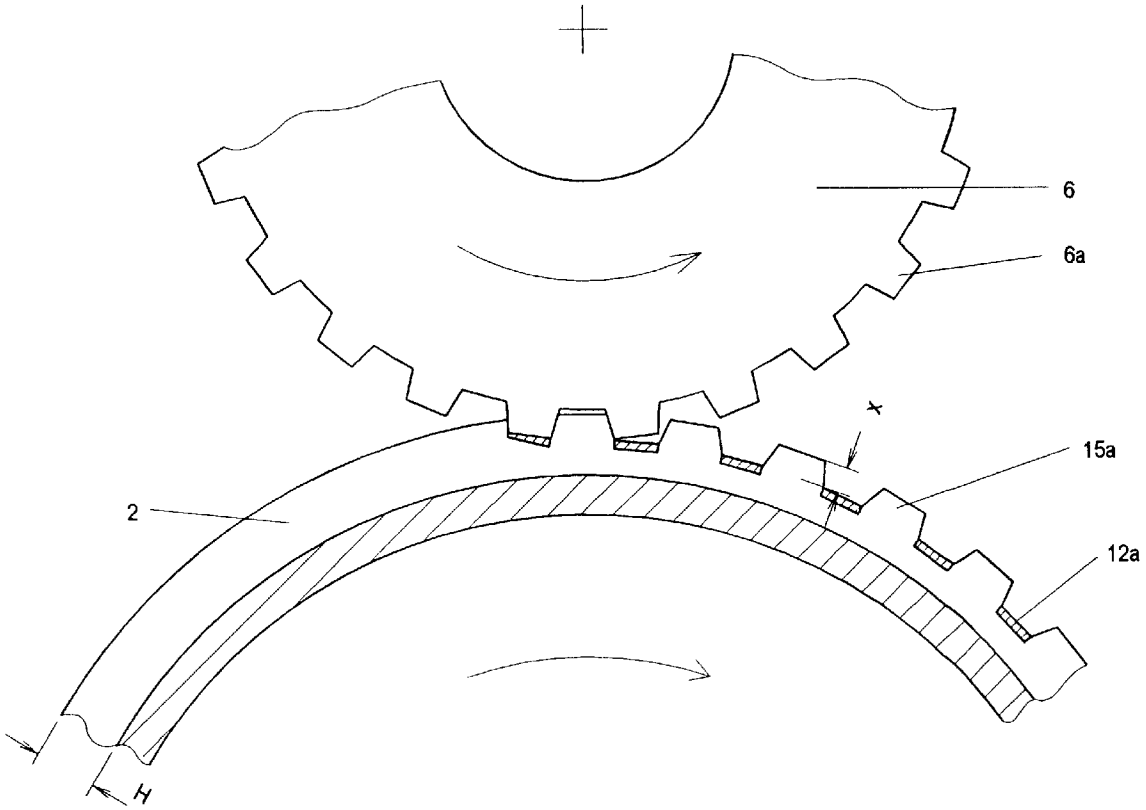
Figure 3B:
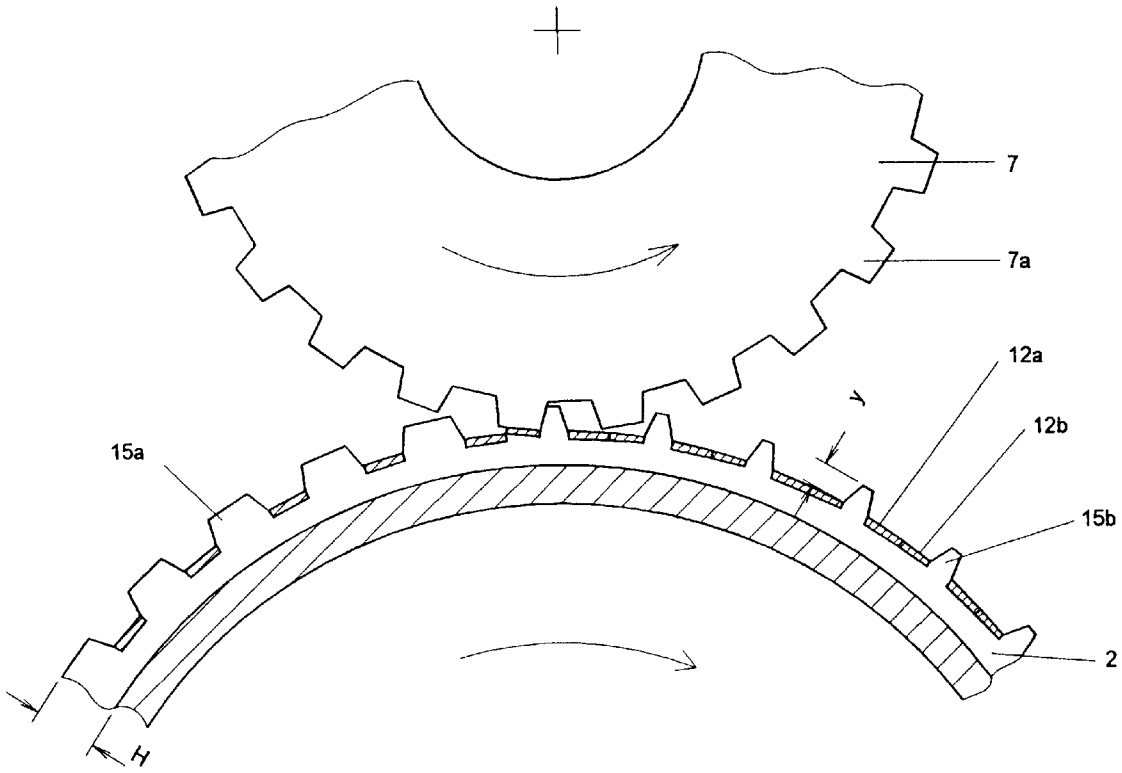

After the fins 2 of the height H have been formed, partially open passages 3 are produced by the following three compression steps:

In a first step, the fins 2 are compressed in sections by the radial compression depth X on the circumference by the teeth 6*a* of a first compression wheel 6 (cf. FIGS. 3*a*/4*a*/5*a*); the external diameter of the first compression wheel 6 is smaller than the diameter of the final rolling wheel 9. Projections 12*a* are formed.

In a second compression step, those sections 15*a* of the fins 2 which have not yet been compressed are partially deformed by the teeth 7*a* of the second compression wheel 7 (cf. 3*b*/4*b*/5*b*), the radial compression depth Y being at least as great as the radial compression depth X in the first compression step. Further projections 12*b* are formed, and the cover 3*a* of the passage 3 is enlarged.

Figure 2:
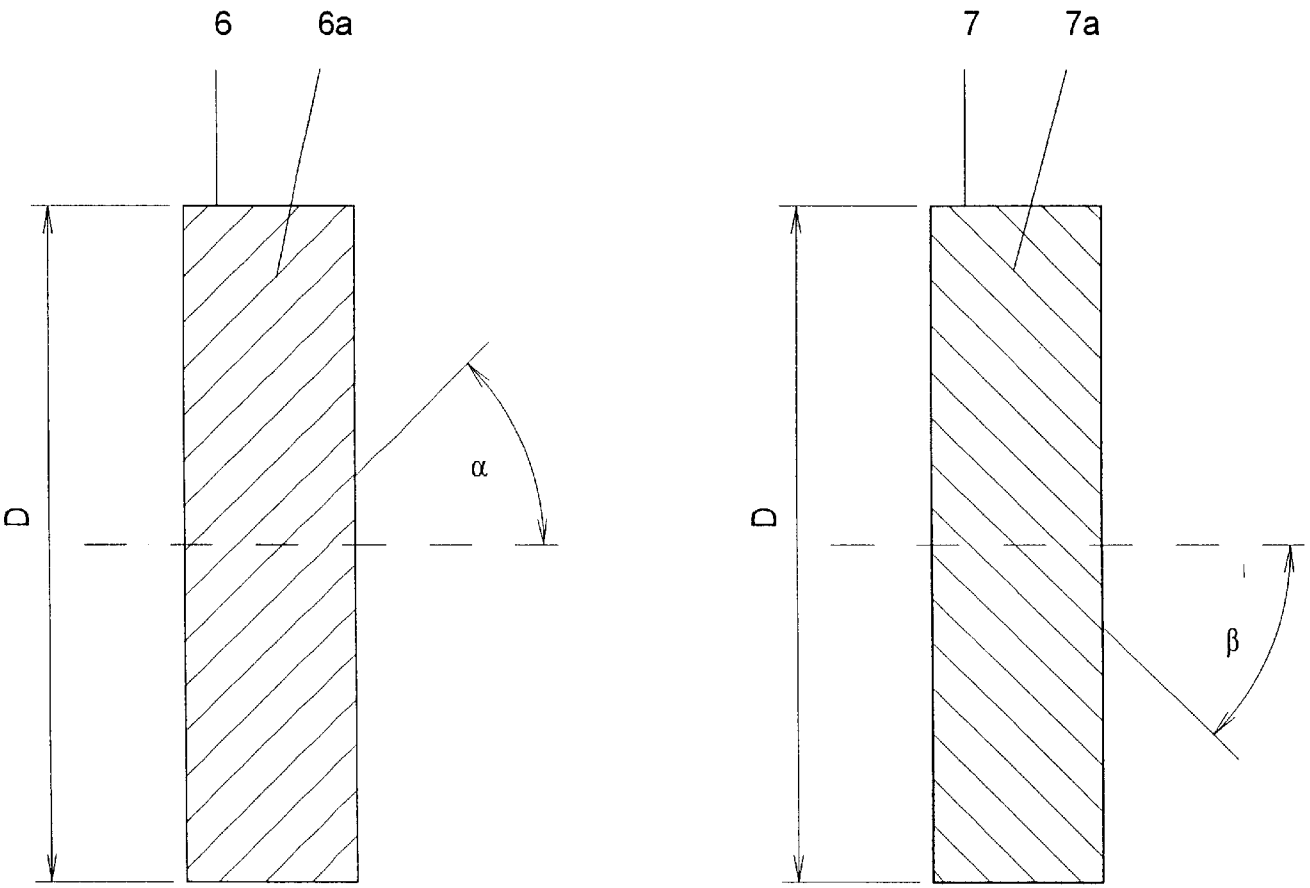

The compression wheels 6, 7 preferably have 10 to 30 teeth 6*a*, 7*a* per cm of circumference, in particular 14 to 25 teeth 6*a*, 7*a* per cm of circumference. The teeth 6*a*, 7*a* run parallel or obliquely at an angle α or β (as shown in FIG. 2) to the respective axis of the wheel.

Figure 3C:
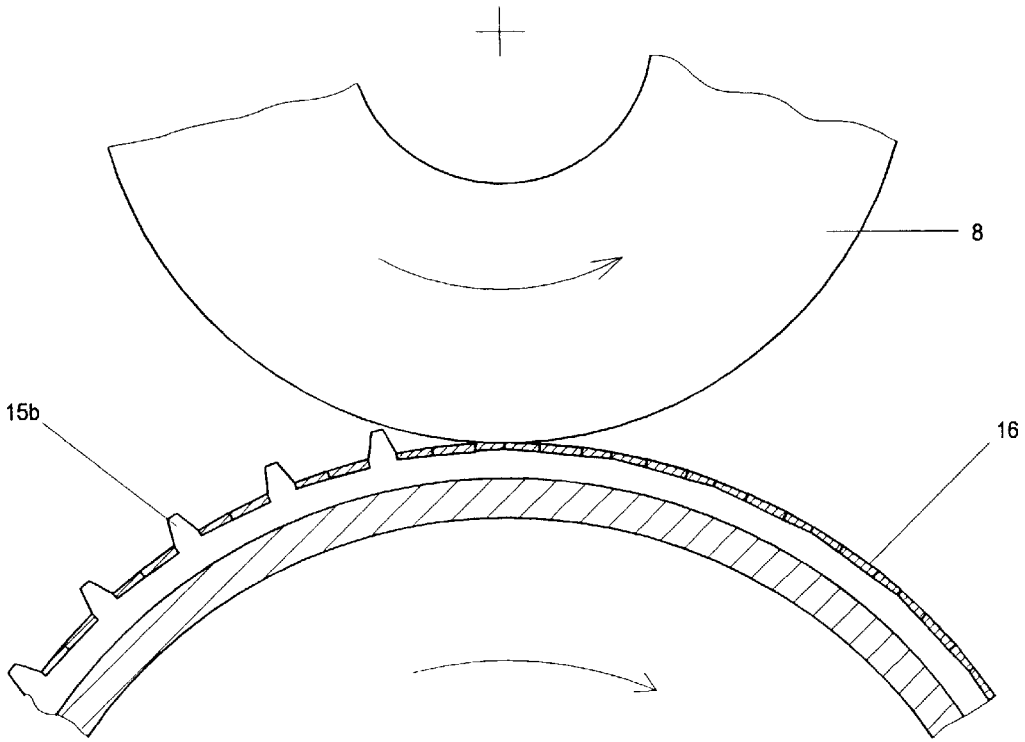

Finally, the tube surface is smoothed by means of a smoothing wheel 8, those sections 15*b* of the fins 2 which have not yet been compressed after the second compression step being smoothed down so as to form the definitive pores 13 or slot 14, via which the passages 3 are in communication with the environment. After the smoothing operation, the outside of the tube 16 no longer has any elevated portions, as can be seen in FIGS. 3*c*/4*c*/5*c*.

Figure 4C:
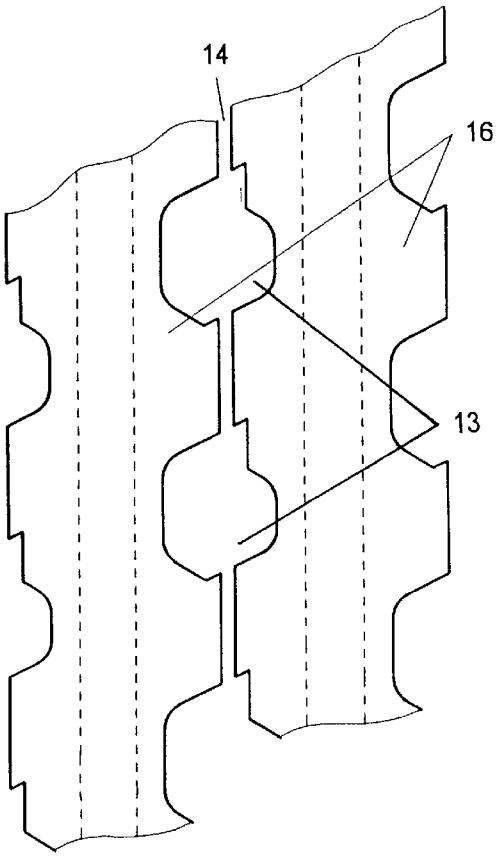
FIGS. 4*a*–4*c* show a plan view of the tube surface with projections which are spaced apart from one another.
Figure 4B:
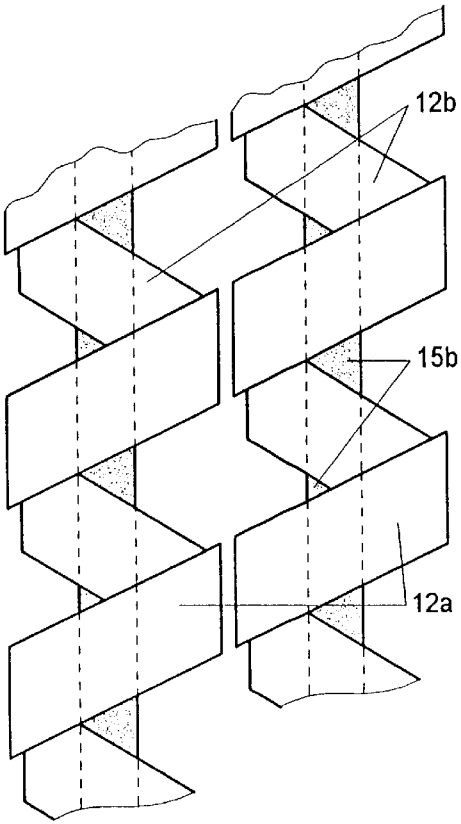
Figure 4A:
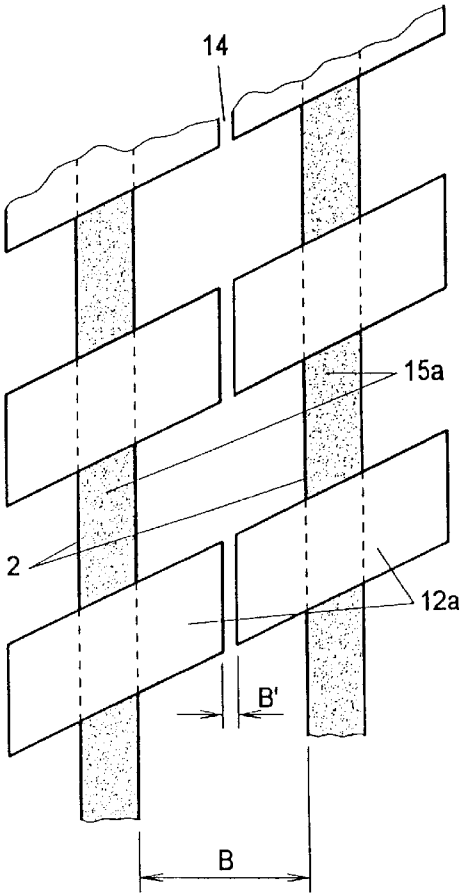

FIGS. 4*a*/4*b*/4*c* illustrate the case in which the projections 12*a*/12*b* of adjacent fins 2 do not touch one another, i.e. a slot 14 of the width B' remains between them. This slot width B' may amount to up to 20% of the open passage width B.

Figure 5C:
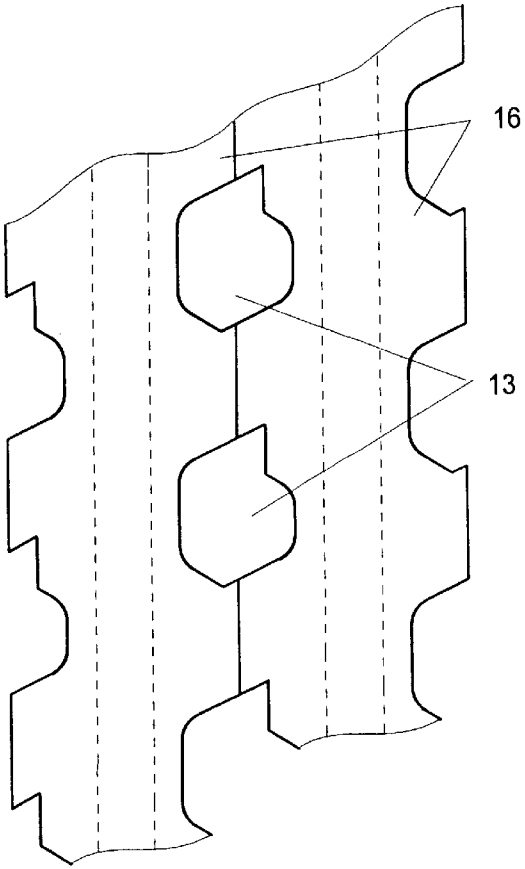
FIGS. 5*a*–5*c* show a plan view of the tube surface with projections which are in contact with one another.
Figure 5B:
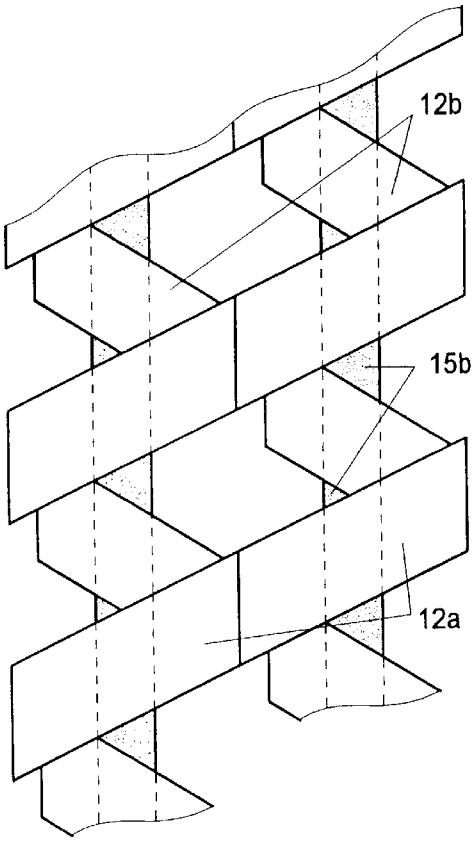
Figure 5A:
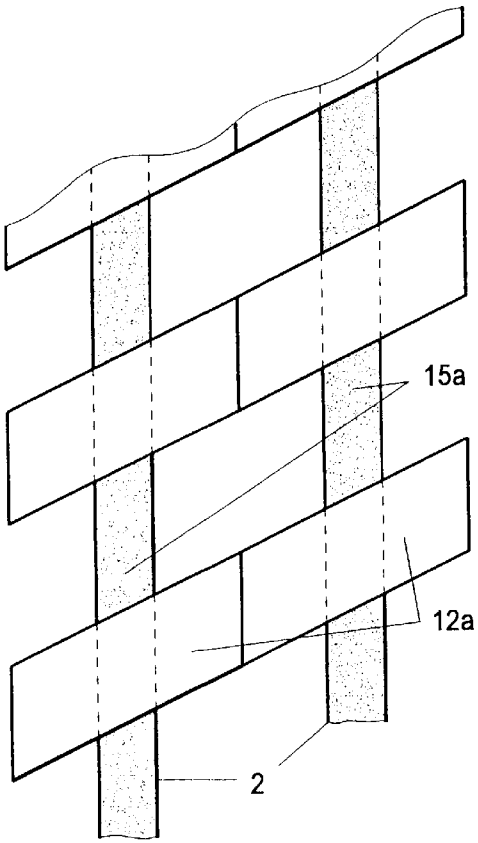

Finally, FIGS. 5*a*/5*b*/5*c* show the case in which the projections 12*a* of adjacent fins 2 are in contact with one another.

Numerical example:

By means of a rolling operation, helically encircling fins 2 are formed out of a smooth copper tube 1', the fin pitch amounting to t=0.41 mm. In the next working step, the fin tip is compressed in sections by the first compression wheel 6 of diameter D=35.0 mm.

The 255 teeth 6*a* which are arranged evenly over the circumference of the compression wheel 6 run at an angle α of 40° to the axis of the wheel. The second compression wheel 7 has the same diameter D as the first compression wheel 6 and the same number Z of teeth 7*a*. The teeth 7*a* of the second compression wheel 7 also run at an angle to the axis of the wheel, but their orientation is opposite to the orientation of the teeth 6*a* of the first compression wheel 6, so that the impressions made by the teeth 6*a* and 7*a* run crosswise on the tube (cf. FIGS. 1/4*b*/5*b*). In order to produce a regular pattern on the tube surface, the angle β which the teeth 7*a* include with the axis of the wheel must be calculated using the following formula:

$$\beta := \arctan(\pi \cdot D/(Z \cdot t) - \tan \alpha).$$

In the present case, this formula results in the angle β being 12.0°.

Advantages of the production process:

The above-mentioned production process makes it possible to manufacture heat exchanger tubes with a highly porous surface structure. In the present case, an evaporator tube was manufactured with such a surface on the basis of integrally rolled fins having a thickness of the order of magnitude of 0.1 mm. Despite the small thickness of the fins, it was possible to essentially close off the passages between the fins with thin covers formed out of the upper region of the fin without the fins buckling sideways or collapsing.

A further advantage is that the proposed production process makes it possible to change the shape and size of the pores in a controlled manner by means of the relative arrangement of the two compression wheels 6 and 7 with respect to one another. It is thus possible to adapt the structure of the tube surface in an optimum manner to the conditions of use (medium employed, pressure, head flux, etc.).

We claim:

1. A process for producing a heat exchanger tube, in particular for the evaporation of liquids from pure substances or mixtures on the outside of the tube, having fins which run helically around the outside of the tube, are integral therewith, i.e. are formed out of the tube wall by working, and are deformed so as to form passages which are situated between the fins, in which process the following steps are carried out:

a) helically running fins are formed on the outside of a smooth tube, the fin material being obtained by displacing material out of the tube wall by means of a rolling operation, and the finned tube which is formed is set in rotation by the rolling forces and/or is advanced in a manner which corresponds to the helical fins which are formed, the fins being formed out of the otherwise undeformed smooth tube with increasing height, b) in the region which is being deformed, the tube wall is supported by a roll mandrel which lies inside the tube, c) after they have been formed, the fins are subjected to a compression operation in order to form partially open passages between them, the fins being compressed by the radial compression depth X over their entire width in the axial direction, in a first compression step in sections in the circumferential direction, by means of a gearwheel-like compression wheel, so that fin material is displaced on both sides in the axial direction so as to form projections which form the first part of the passage cover, d) at least one further compression step with the radial compression depth Y is carried out over the entire width of the fins in the axial direction, by means of a gearwheel-like compression wheel, which radial compression depth Y is at least as great as the radial compression depth X in the first compression step, so that the passage cover is formed in a stepwise manner by joining together projections.

2. The process as claimed in claim 1, wherein the radial compression depth X is in the range of 10% up to 50% of the fin height (H).

3. The process as claimed in claim 1, wherein the first and second circumferentially extending regions are compressed in such a manner that a slot remains between the first and second projections of adjacent fins.

4. The process as claimed in claim 3, wherein the slot width B' amounts to up to 20% of the open passage width B.

5. The process as claimed in claim 1, wherein the first and second circumferentially extending regions are compressed in such a manner that the projections of adjacent fins touch one another.

6. The process as claimed in claim 1, wherein the first and second circumferentially extending regions are compressed by gear-like compression wheels which have thereon 10 to 30 teeth per cm of its circumference.

7. The process as claimed in claim 6, wherein the compression wheels have teeth extending parallel to the axis of rotation thereof.

8. The process as claimed in claim 6, wherein the compression wheels have teeth extending obliquely at an angle to the respective axis of rotation thereof.

9. The process as claimed in claim 6, wherein the compression wheels have in each case 14 to 25 teeth per cm of the circumferences thereof.

10. The process as claimed in claim 9, wherein the compression wheels have teeth extending parallel to the respective axis of rotation thereof.

11. The process as claimed in claim 9, wherein the compression wheels have teeth extending obliquely at an angle to the respective axis of rotation thereof.

12. The process as claimed in claim 9, wherein, if compression wheels of the same diameter D and with the same number of teeth are used, the angles of the teeth to the respective axis of rotation are adapted to one another according to the formula:

$$\beta=\arctan(\pi\cdot D/(Z\cdot t)-\tan\alpha)$$

where t is the pitch of the fins.

* * * * *

UNITED STATES PATENT AND TRADEMARK OFFICE

CERTIFICATE OF CORRECTION

PATENT NO. : 6,067,832
DATED : May 30, 2000
INVENTOR(S) : Karine Brand et al.

It is certified that error appears in the above-identified patent and that said Letters Patent is hereby corrected as shown below:

Column 6, claim 1,
Should read as follows:

1. A process for producing a heat exchanger tube for the evaporation of liquids from pure substances or mixtures on the outside of the tube, said heat exchanger tube having fins which extend helically around the outside of the tube, are integral therewith by being formed out of the tube wall through working, and are deformed so as to form passages which are situated between the fins, comprising the steps of:

a) forming helically extending fins on the outside of a smooth surface tube, the fin material being obtained by displacing material radially outwardly of the tube wall by means of a rolling operation, and the finned tube which is formed is set in rotation by the rolling forces and/or is advanced in a manner which corresponds to the helical fins which are formed, the fins being formed out of the otherwise undeformed smooth tube with increasing height;

b) supporting by a roll mandrel oriented inside the tube the region of the tube which is being deformed;

c) compressing selected first circumferentially extending regions of the fully formed fins in order to form partially open, axially extending, passages between them, the fins being compressed by the radial compression to a depth X over their entire width in the axial direction by means of a first gear-like compression wheel causing fin material to be displaced on both sides of the fin in the axial direction so as to form first projections which form a passage cover;

d) compressing selected second circumferentially extending regions of the fully formed fin to a radial compression depth Y over the entire width of the fins in the axial direction by means of a second gear-like compression wheel, said radial compression depth Y being at least as great as the radial compression depth X causing fin material to be displaced on both sides of the fin in the axial direction so as to form second projections which form a second part of the passage cover; and

UNITED STATES PATENT AND TRADEMARK OFFICE

CERTIFICATE OF CORRECTION

PATENT NO. : 6,067,832
DATED : May 30, 2000
INVENTOR(S) : Karine Brand et al.

It is certified that error appears in the above-identified patent and that said Letters Patent is hereby corrected as shown below:

compressing selected third circumferentially extending regions constituting the remainder of the fully formed fin to a radial compression depth that is at least as great as the compression depth Y by a smooth surface wheel to thereby form a smooth exterior surface on an exterior of said tube.

Signed and Sealed this

Twenty-seventh Day of November, 2001

*Attest:*

Nicholas P. Godici

NICHOLAS P. GODICI

*Attesting Officer*

*Acting Director of the United States Patent and Trademark Office*